United States Patent [19]

Dick

[11] 4,026,065

[45] May 31, 1977

[54] POLYHEDRAL ELEMENTS WITH UNDERCUT RECESSES AND CYLINDRICAL CONNECTORS HAVING COLLARS

[76] Inventor: Walter Dick, 30 Bahnofstrasse, 5908 Neunkirchen, Germany

[22] Filed: Nov. 14, 1975

[21] Appl. No.: 631,812

Related U.S. Application Data

[63] Continuation of Ser. No. 538,798, Jan. 6, 1975, which is a continuation of Ser. No. 398,160, Sept. 17, 1973, which is a continuation of Ser. No. 234,088, March 13, 1972, abandoned.

[52] U.S. Cl. ..... 46/25; 46/26

[51] Int. Cl.[2] ..... A63H 33/08

[58] Field of Search ..... 46/25, 26, 29, 28

[56] References Cited

UNITED STATES PATENTS

| | | | |
|---|---|---|---|
| 2,100,658 | 11/1937 | Finch | 46/26 |
| 2,791,868 | 5/1957 | Viken | 46/30 |
| 2,855,206 | 10/1958 | Haviland | 46/25 |
| 3,374,917 | 3/1968 | Troy | 46/25 |
| 3,389,493 | 6/1968 | Zysset | 46/25 |

FOREIGN PATENTS OR APPLICATIONS

| | | | |
|---|---|---|---|
| 1,218,924 | 12/1959 | France | 63/DIG. 3 |

*Primary Examiner*—G.E. McNeill

*Attorney, Agent, or Firm*—Norman S. Blodgett; Gerry A. Blodgett

[57] ABSTRACT

A group of building blocks made from plastic to create area- or volume-shaped designs including cube-shaped basic elements connecting elements by which means a basic element is connected to another basic element. The connecting elements are cylinders with rounded collars which are forced into undercut recesses in the base elements. The base elements may be straight prisms or other polyhedral shapes. Several base elements may be formed in one piece. The connectors may be integral or separate and the connectors and base elements may have communicating bores.

3 Claims, 9 Drawing Figures

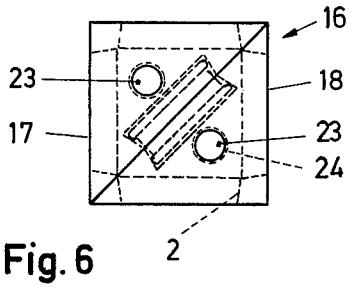
Fig. 6
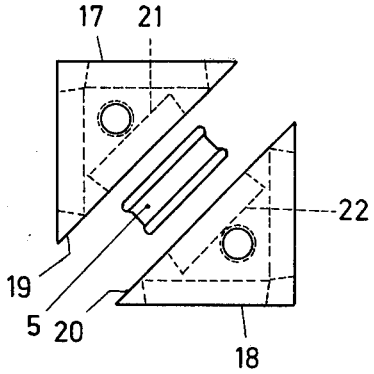
Fig. 8
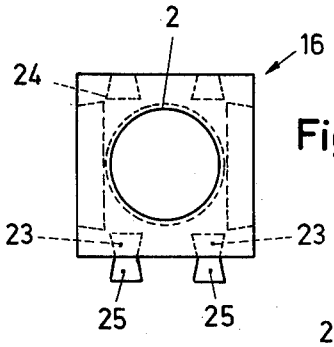
Fig. 7
Fig. 9
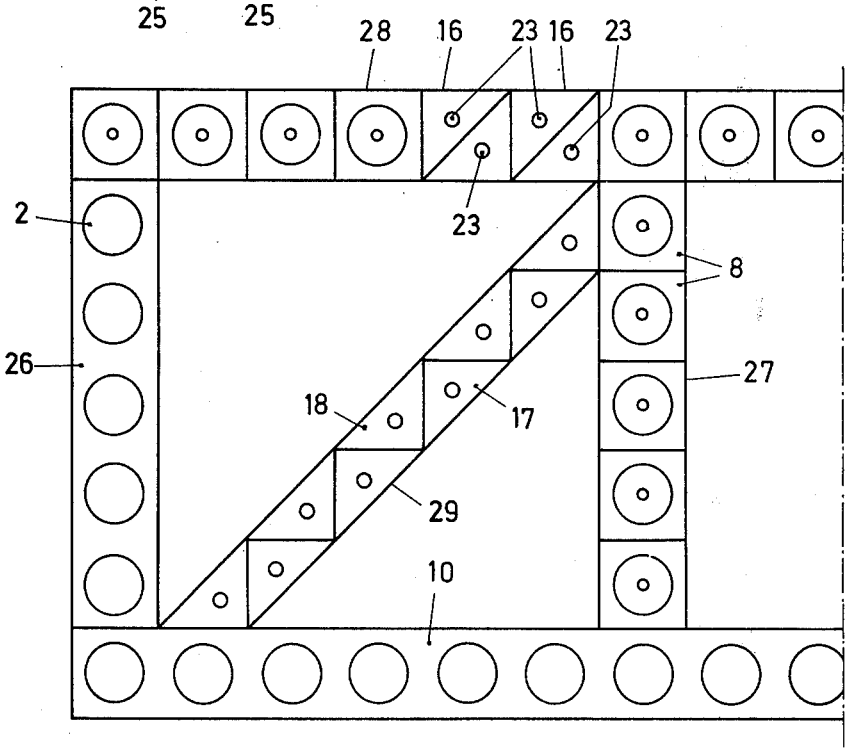

POLYHEDRAL ELEMENTS WITH UNDERCUT RECESSES AND CYLINDRICAL CONNECTORS HAVING COLLARS

This is a continuation of application Ser. No. 538,798 filed Jan. 6, 1975, which is a continuation of application Ser. No. 398,160 filed Sept. 17, 1973, which is a continuation of application Ser. No. 234,088 filed Mar. 13, 1972, now abandoned.

BACKGROUND OF THE INVENTION

It has been suggested in the past that different building block elements be made from plastic. For instance, a group of play-building blocks have been provided which consist mainly of a square building block body which is equipped on one side surface with one or more projections and which is provided on the opposing surface with one or more recesses which is conjugate to the projections. The projections of another building block element may then be pressed into these recesses by a small deformation into extended position or in a position offset by 20°. By such an interlocking of a number of building blocks, area and volume structures may be formed. These known building elements, however, have the disadvantage that the fitting of several building elements can only be made to opposing surfaces which are equipped with a conjugate element, i.e., a projection or a recess. To a surface positioned at a right angle to the base surface, no other building block may be attached. Furthermore, it is not possible with these known building elements to connect these building elements by struts positioned at an acute angle, for example an angle of 45°.

Furthermore, it is known to provide a building block group made from plastic to make area- or volume-shaped designs, which group consists of a cubical building block basic element and one connecting element. The basic element contains at least two opposing surfaces and dove-tail shaped grooves which are pressed onto correspondingly-shaped connecting members to connect one building block element to the other. Also, there is a building block group available wherein the basic elements are already equipped with a dove-tail shaped protrusion in place of the dove-tail groove, so that they may be connected to another basic element without a connecting member, which element, however, has to have a dove-tail groove. Also with this group, the basic elements can only be placed in a certain predetermined position. By use of a 45° element, it is possible to create an acute angle, but deviations from this angle are not possible. Based on the dove-tailed groove and the dove-tailed protrusion, an additional attaching of further basic elements is not possible on every location, but only on the end surfaces. It is, therefore, an outstanding object of the invention to provide a structural system capable of being used to construct a wide range of configurations.

Another object of this invention is the provision of structural elements of simple design which may be locked together to form strong structural combinations.

A further object of the present invention is the provision of structural elements for use in buildings or the like formed inexpensively of plastic.

It is another object of the instant invention to provide structural system consisting of elements which are simple in construction, inexpensive to manufacture, and which are capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention comprises a building block group made from plastic to make area- or volume-shaped designs, the group consisting of a cube-shaped basic element and a connecting member by which one or several basic elements on various areas of another basic element can be connected with each other, positioned in an angle to each other, and may be twisted relative to each other. This will be achieved, according to this invention, because the cube-shaped base element is equipped on each surface with a cylindrical, undercut recess and the cylindrical connecting member contains on each end a circumferential collar capable of cooperating with one recess of another cube-shaped basic element. In each of these recesses of the basic element, a connecting member can be inserted which then can take a further basic element. The basic elements connected in this way can be twisted in any desired angle because of the circumferential cross-section of the recess and the connecting member.

Considering that basically a cube-shaped basic element is connected to another basic element, where a connecting member always has to be used, another characteristic of this invention suggests that the cube-shaped basic element can be fabricated in one piece with the connecting member. By this method, the insertion operation during the connection of two cube-shaped basic elements is eliminated. Furthermore, it is suggested that, when assembling several basic elements to form a plate or a strut, several basic elements are made as one building element, for example, in the form of a plate or a strut.

During assembling of struts or supports, it is not always necessary that all cube-shaped basic elements contain the cylindrical recess and have to be able to be put together. To achieve a simple building element for this purpose this invention suggests this building element be equipped with an intermediate element of cylindrical or hollow cylindrical shape having the length of a side of a basic element, and the intermediate element be equipped on its two front surfaces with cylindrical undercut recesses to receive the connecting member. To eliminate this insertion operation, the connecting element is fabricated integral with the intermediate element. Also, in this case several of the cylindrical or hollow cylindrical intermediate elements may be fabricated in one piece as a bar.

According to another characteristic of this invention, the cube-shaped basic element is formed as two identical straight prisms of triangular base and top area which have in the area of separation cylindrical recesses and are connected to each other by a connecting member. With this design, it is possible to erect an inclined strut directly on top of a cube-shaped basic element, the basic element and the strut being kept in the same plane. Each prism has its base and cover area provided with an undercut recess for the insertion of a connecting pin which is somewhat thicker at its ends. With this design, several prisms may be mounted on one prism of greater height. To eliminate the insertion of the connecting pin, the prism and the connecting pin are made of one piece. The distance between the outer edge of the recesses of two prisms forming one base element is equal to the diameter of the recess within the basic element. In this way, a one-piece basic element can be attached to all areas of a basic element formed by two prisms. To eliminate the insertion operation during connection of a one-piece basic element to a prism, each prism and connecting element is made from one piece. The undercuts of the recesses within the basic element, the intermediate element, and the prism are shaped conically or as circumferential grooves, so that a collar of a connecting element may always be locked securely into these recesses.

BRIEF DESCRIPTION OF THE DRAWINGS

The character of the invention, however, may be best understood by reference to one of its structural forms, as illustrated by the accompanying drawings, in which:

FIG. 6 shows a basic element formed by two prisms joined together, FIG. 7 is a plan view of the basic element shown in FIG. 6, FIG. 8 shows the basic element of FIG. 6 in separated condition, and FIG. 9 shows another design formed by a building block group used in accordance with the present invention.

DESCRIPTION OF THE PREFERRED EMBODIMENT

Figure 1:
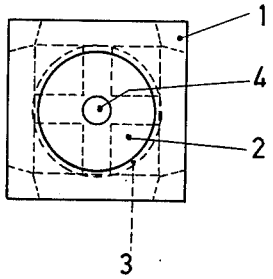
FIG. 1 is a front elevational view of a basic structural element incorporating the principles of this invention.
Figure 3:
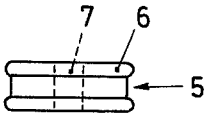
FIG. 3 shows a connecting element.
Figure 4:
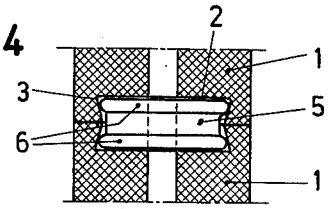
FIG. 4 shows a section through two basic elements joined by a connecting member.

FIG. 1 of the drawing shows a cube-shaped basic element 1 made from plastic. This basic element is equipped on each of its sides with a recess 2 which has a conical undercut 3. From the base area of each recess 2 extends a concentric hole 4 directed toward the base area of the recess of the basic element's opposing side. Into each of these recesses 2 can be inserted a cylindrical connecting member 5 (shown in FIGS. 3 and 4) which is equipped at each end with a circumferential collar 6. The diameter of the connecting element 5 with the two collars 6 is related to that of the recess 2 in such a way that the connecting element 5 is positively locked within the recess 2. In FIG. 4 the cylindrical portion of connecting member 5 is shown to be smaller than the smallest diameter of recess 2 and collars 6 have their edges (the edges spaced, longitudinally of the cylindrical portion) rounded. The rounded collar will co-act with the narrow end of conical undercut 3 to urge the collar inward. Connecting member 5 is shown slightly spaced from the bottoms of recesses which it occupies. With the help of a connecting element 5 each of the six surfaces of the basic element 1 can be attached to another basic element 1, so that several basic elements 1 with a corresponding number of connecting elements 5 can be used to construct an area- or volume-shaped design. The connecting element 5 is advantageously equipped with a center hole 7 by which means the connecting member 5 may be disconnected later on, for example, by means of a pin inserted into the hole. The diameter of the hole 7 in the connecting member 5 is made equal to the diameter of the hole 4 within the basic element 1.

Figure 2:
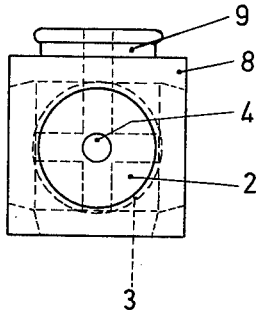
FIG. 2 shows a basic element with an integral connecting member.

FIG. 2 of the drawing shows another basic element 8 which also has the shape of a cube. The base element 8 has on five side areas cylindrical recesses 2, in the same manner as the base element 1, these recesses also being formed with an undercut 3. The oppositely-positioned surfaces of this base element 8 are also connected with each other by concentric holes 4. In comparison to the base element 1, this base element 8 is equipped with a connecting element 9 on the 6th side surface and is formed integrally with base element 1. Through this one-piece system provided by the base element 8 and the connecting member 9, one insertion operation may be eliminated in putting together several base elements 8.

Figure 5:
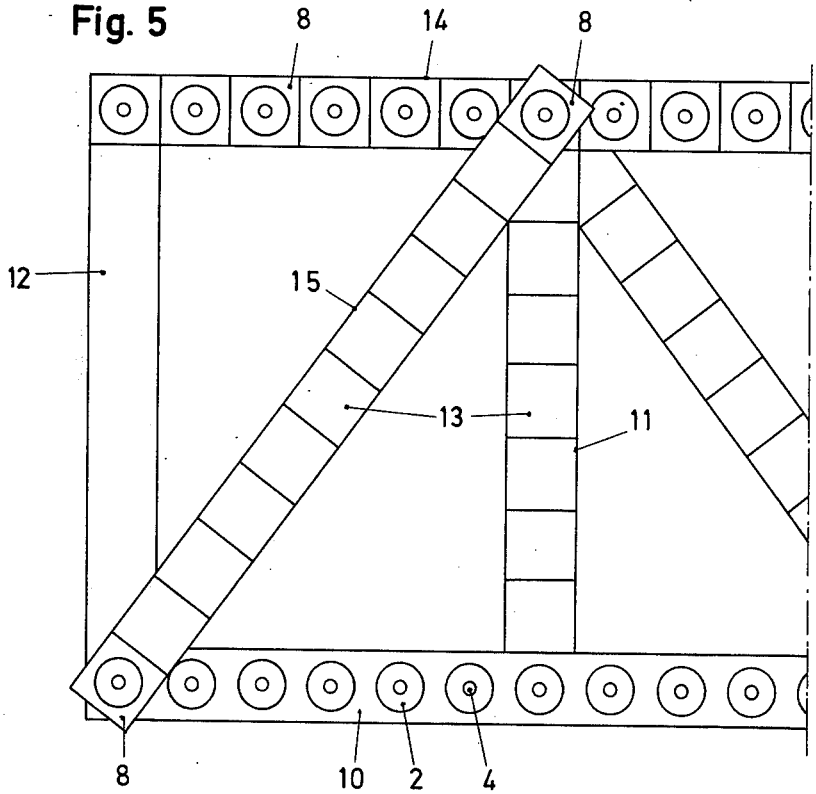
FIG. 5 shows a building block group design.

FIG. 5 of the drawing shows a part of a bridge-like design which is formed from building elements constructed in accordance with this invention. To eliminate the assembly of several base elements 8 in making a plate, several base elements 8 are made here in one piece. All surfaces of this plate 10 have recesses 2 in the corresponding places. In addition, holes 4 can also be made available on this plate 10. On top of the plate 10 are mounted vertical struts 11 and 12. Because no further base elements 1 or 8 have to be connected to these struts 11 and 12, the strut 11 consists of several hollow cylindrical intermediate pieces 13, whose length is equal to the length of the side of the base element 8. These hollow cylindrical intermediate pieces 13 are equipped on their front faces only with cylindrical undercut recesses which are shaped in the same way as the recesses 2 of the basic elements 1 and 8 and into which connecting members can be inserted. To eliminate also here the operation of inserting a connecting member 5, for practical purposes, there is always fabricated one intermediate piece 13 together with a connecting member 5 as explained in connection with the base element 8. In a strut 11 assembled from intermediate hollow pieces 13 a reinforcing rod could be pushed through if need be, so that the stiffness of the strut 11 could be considerably increased. This could be especially advantageous when longer struts 11 are used. The strut 12 is fabricated in one piece from hollow cylindrical intermediate pieces 13, so that the assembly of intermediate pieces 13 may be eliminated. However, the two front areas of the strut 12 are equipped with recesses having undercuts, which serve to attach each connecting member 5. To the two struts 11 and 12 is mounted a cross brace 14 which is formed of a number of base elements 8. Through the holes 4 of the base elements 8 is pushed a reinforcing rod, so that the stiffness of the cross brace is increased. To stabilize the position of the cross brace 14 and struts 11 and 12, there is provided a diagonal strut 15, forming a bridge-shaped design. This diagonal strut 15 consists of several hollow cylindrical intermediate pieces 13 similar to the strut 11 and on the end of the strut is mounted a cube-shaped base element 8. These two base elements 8 are fastened at the sides on the plate 10 and on the cross brace 14 by additional connecting members 5. The circularly-shaped cross-section of the recesses 2 and the connecting members 5 permits the angular positioning of the two base elements 8 and with it the positioning of the strut 15.

The hole 4 in the base elements 1 and 8 and the hole 7 in the connecting member 5, also serve for de-airing during assembly and can be used for the insertion of nail-shaped parts. By a suitable coloring of these nail-shaped parts, a mosaic may be formed. Furthermore, shafts or spindles may be inserted into these holes 4 and 7, so that wheels, for the design of a toy vehicle, may be fastened to a base element. It is also possible to attach plates to the base elements and the intermediate pieces 13 where the thickness is about half the height of a connecting member 5. These plates for example are equipped only on their four corners with correspondingly-shaped holes, for the attachment of the connecting members 5.

FIGS. 6 and 7 of the drawing show a cube-shaped base element 16 which is formed by two connected identical straight prisms 17 and 18 with triangular base and end surfaces. As can be seen in FIG. 8, the planes of separation 12 and 20 of the prisms 17 and 18 are provided with recesses 21 and 22 of circular-shaped cross-section. These recesses have the same size and shape as the recesses 2 within the base elements 1 and 8. These recesses 21 and 22 make it possible for the connecting element 5 to be inserted to connect the two prisms 17 and 18 to form the cube-shaped element 16. On the base and on the top surface of each prism 17 and 18 is located a hole 23 with an undercut 24, into which (as shown in FIG. 7) are inserted connecting pins 25 which are reinforced at their ends. By means of these holes 23 and the pins 25, it is possible to mount several prisms 17 and 18 on one prism of larger height. To eliminate the operation of inserting a connecting rod 25, a connecting pin 25 may be made integral with the prisms 17 and 18 attached on the base and top area of the prism 17 and 18.

In the two side areas which always form a parallelogram with each prism 17 and 18, is arranged a recess 2, so that the side areas of each prism 17 and 18 may be connected with a one-piece base element 1 or 8. In that way it is possible, as explained in connection with FIG. 2, to arrange on one side surface of a prism 17 and 18 in place of a recess 2, a one-piece connecting member as is the case on the basic element 8. By this method, one operation can be eliminated. The distance between the opposing edges of the holes 23 and of the pins 25 of two assembled prisms 17 and 18 which make a cube-shaped base element 16, is equal to the diameter of the recess 2 so that a one-piece base element 1 or 8 may be attached to the base element 16.

FIG. 9 of the drawing shows also a bridge-shaped design which was assembled from building blocks made in accordance with this invention. This design consists also of a plate on which vertical struts 26 and 27 are mounted. The strut 27 is formed from several base elements 8 and the strut 26 is made from several base elements 8 but in one piece. The side areas of the strut 26 are equipped at corresponding locations with recesses 2. On the two struts 26 and 27 is mounted a cross brace 28, which consists of a number of assembled base elements 8 and of two base elements 16. To secure the cross brace 28 and the struts 26 and 27 in position this design is provided with a strut 29 consisting of a number of prisms 17 and 18 connected by means of connecting members 5 and 9. This strut 29 is located in the plane of the struts 26 and 27 and the cross brace 28.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Construction toy, comprising a. a polyhedral base element having at least one plane face and a recess opening onto the face, the surface of the recess being in the form of the frustrum of a cone with the larger diameter located inwardly of the face, the depth of the recess being substantially less than said diameter, and a bore leaving the center of the bottom of the recess and extending through the base element, the said surface of the recess extending completely from the said face to the said bottom, and b. a connecting member consisting of a short cylindrical portion having a diameter less than the smallest diameter of the recess in the base element and an integral circumferential collar in the form of an annular surface, and a bore extending axially through the member, the diameter of the collar being greater than the lesser diameter of the recess said annular surface having means including rounded edges longitudinally of said cylindrical portion to co-act with said recess surface and aid movement of said collar into said recess, and c. a second polyhedral base element with which the connecting member is connected, the cylindrical portion extending from a plane face thereof, the distance from the latter plane face to the outer end of the connecting member being less than the depth of the recess.

2. Construction toy as recited in claim 1, wherein the connecting member is integrally connected in mirror relationship to an exactly similar connecting member and the second polyhedral base element is separately formed from the connecting member.

3. Construction toy as recited in claim 1, wherein the second polyhedral base element is integral with the connecting member.

* * * * *